United States Patent [19]

Cabaluna

[11] 3,977,422

[45] Aug. 31, 1976

[54] CONCEALED LITTER BAG CANE DEVICE

[75] Inventor: Wenceslao Cabaluna, Chateaugay, N.Y.

[73] Assignee: The Raymond Lee Organization, Inc., New York, N.Y. ; a part interest

[22] Filed: May 1, 1975

[21] Appl. No.: 573,457

[52] U.S. Cl. ..... 135/66; 119/1; 294/19 R; 294/55

[51] Int. Cl.[2] ..... A45B 3/00

[58] Field of Search ..... 43/6, 12, 19; 119/1, 119/153; 294/19 R, 55

[56] References Cited

UNITED STATES PATENTS

| | | | |
|---|---|---|---|
| 2,556,650 | 6/1951 | Hicks et al. | 43/12 |
| 2,683,949 | 7/1954 | Berezansky | 43/12 |
| 2,833,266 | 5/1958 | Mares | 43/6 |
| 3,045,659 | 7/1962 | Malcolm | 43/6 |
| 3,093,402 | 6/1963 | Sisson | 294/19 R |
| 3,446,525 | 5/1969 | Jones | 294/19 R |
| 3,819,220 | 6/1974 | Bredt | 294/19 R |
| 3,828,459 | 8/1974 | Easom | 43/19 |

FOREIGN PATENTS OR APPLICATIONS

| | | | |
|---|---|---|---|
| 1,394,794 | 3/1965 | France | 43/12 |

*Primary Examiner*—Werner H. Schroeder
*Assistant Examiner*—Conrad L. Berman
*Attorney, Agent, or Firm*—Daniel Jay Tick

[57] ABSTRACT

A hollow cane has a handle at one end thereof and an opening at the other end thereof. A rigid wire extends from a piston in the cane to the area of the open end of the cane. A flexible wire is affixed at one end to the free end of the rigid wire and is affixed at the other end to the cane adjacent the opening thereof. A litter bag is mounted on the flexible wire. An ejecting device is provided in the cane in the area of the handle for moving the piston toward the open end of the cane thereby moving the flexible wire out of the cane through the open end thereof, at which time the flexible wire forms a loop and supports the litter bag in open condition outside the cane.

1 Claim, 4 Drawing Figures

CONCEALED LITTER BAG CANE DEVICE

DESCRIPTION OF THE INVENTION

The present invention relates to a concealed litter bag cane device.

Objects of the invention are to provide a concealed litter bag cane device of simple structure, which is inexpensive in manufacture, used with facility and convenience as an ordinary cane or as a litter bag device, especially for picking up after dogs, and functions efficiently, effectively and reliably as an ordinary cane and as a litter bag device for holding a litter bag in open condition to catch dog droppings and thereby avoid pollution of the streets.

In order that the invention may be readily carried into effect, it will now be described with reference to the accompanying drawing, wherein.

In the FIGS., the same components are identified by the same reference numerals.

Figure 1:
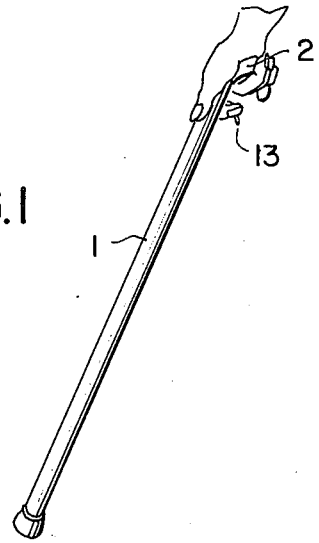
FIG. 1 is a perspective view of an embodiment of the concealed litter bag cane device of the invention.

The concealed litter bag cane device of the invention comprises a hollow cane 1 having a handle 2 at one end thereof and an opening 3 (FIG. 2) at the other end thereof.

A piston 4 is provided in the cane 1. A substantially rigid wire or bar 5 extends from the piston 4 to the area of the open end 3 of the cane, as shown in FIG. 2.

A substantially flexible wire 6 (FIG. 2) is affixed at one end 7 to the free end 8 of the rigid wire 5 and is affixed at the other end 9 to the cane adjacent the opening 3 thereof.

Figure 2:
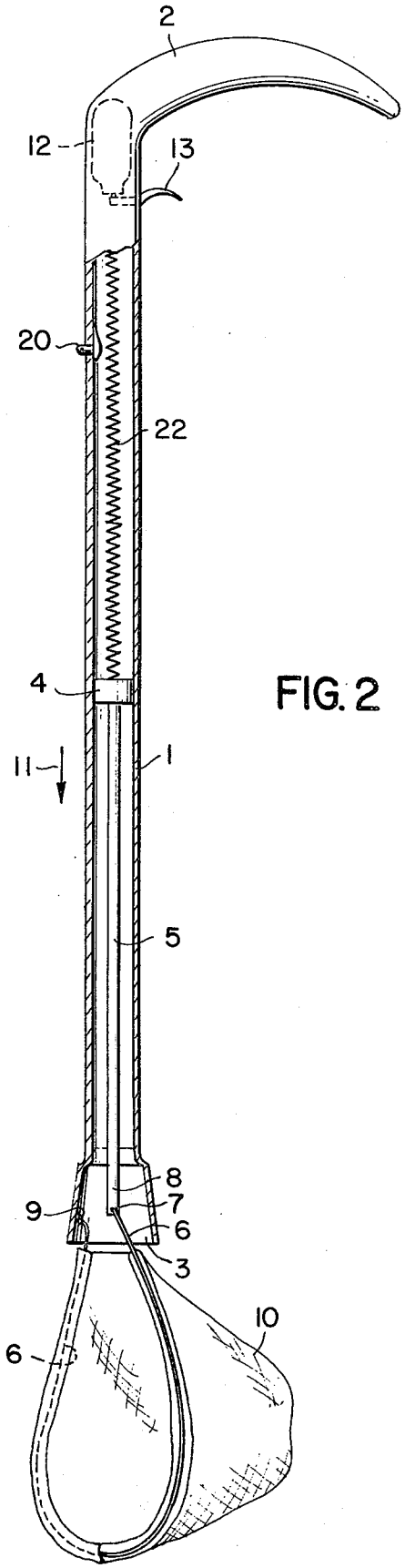
FIG. 2 is a partly cutaway view, partly in section, on an enlarged scale, of the embodiment of FIG. 1 in condition as a litter bag device.

As shown in FIG. 2, a litter bag 10 is mounted on the flexible wire 6.

Figure 3:
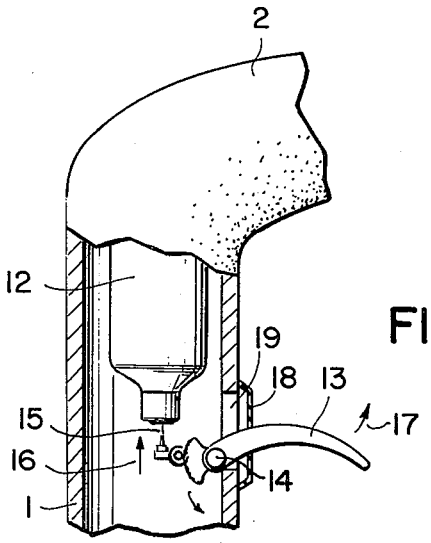
FIG. 3 is a partly cutaway view, partly in section, on an enlarged scale, of an embodiment of the ejecting device of the concealed litter bag cane device of the invention.

An ejecting device, shown in detail in FIG. 3, is provided in the cane 1 in the area of the handle 2 for moving the piston 4 in the direction of an arrow 11 (FIG. 2) toward the open end 3 of the cane thereby moving the flexible wire 6 out of the cane through the open end thereof, said flexible wire forming a loop and supporting the litter bag 10 in open condition outside the cane, as shown in FIG. 2.

The ejecting device comprises a container 12 of gas in the cane 1 on the opposite side of the piston 4 from the rigid wire 5, as shown in FIG. 3. The ejecting device further comprises a trigger 13 (FIG. 3) extending outside the cane 1 for releasing gas from the container 12. This is accomplished by pivotally mounting the trigger 13 on a pivot pin 14 and having a valve pin 15 affixed to the end of the trigger inside the cane. The valve pin 15 has a sharp point which functions as a stopper for an opening in the container 12 when said valve pin moves in the direction of an arrow 16 (FIG. 3) into said opening. When the trigger 13 is pulled in the direction of an arrow 17 (FIG. 3) the valve pin 15 is removed from the opening of the container 12 and gas under pressure is supplied to the area of the cane behind the piston 4 under sufficient pressure to force the piston toward the open end 3 of the cane in the direction of the arrow 11 shown in FIG. 2. A flexible pressure-tight seal 18 is provided around the trigger 13 over the trigger hole 19 of the cane to prevent the escape of gas from the cane.

Figure 4:
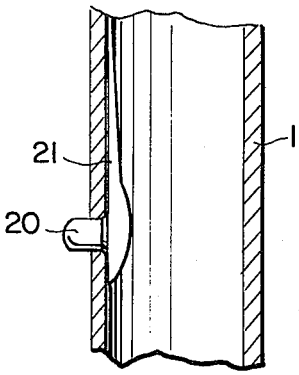
FIG. 4 is a sectional view, on an enlarged scale, of part of the concealed litter bag cane device of the invention.

As shown in FIG. 4, a gas release device 20 is provided for releasing gas from the cane to permit the piston 4 to move back into the cane after the flexible wire 6 has been ejected therefrom. The gas release device 20 comprises a hole formed through the cane and a valve button functioning as a stopper for such hole and biased by a spring 21 so that it is constantly stopping the hole unless depressed by manual force.

A spring 22 (FIG. 2) in the cane 1 extends between the opposite side of the piston 4 from the rigid wire 5 and the handle 2 of the cane. The spring 22 functions to draw the flexible wire 6 back into the cane after the gas is released from the cane.

While the invention has been described by means of a specific example and in a specific embodiment, I do not wish to be limited thereto, for obvious modifications will occur to those skilled in the art without departing from the spirit and scope of the invention.

I claim:

1. A concealed litter bag cane device, comprising a hollow cane having a handle at one end thereof and an opening at the other end thereof;

a piston in the cane;

a substantially rigid wire extending from the piston to the area of the open end of the cane;

a substantially flexible wire affixed at one end to the free end of the rigid wire and affixed at the other end to the cane adjacent the opening thereof;

a litter bag mounted on the flexible wire; and ejecting means in the cane in the area of the handle for moving the piston toward the open end of the cane thereby moving the flexible wire out of the cane through the open end thereof, said flexible wire forming a loop and supporting the litter bag in open condition outside the cane.

said ejecting means comprises a container of gas in the cane on the opposite side of the piston from the rigid wire and trigger means extending outside the case for releasing gas from the container; and gas release means for releasing gas from the cane and a spring in the cane extending between the opposite side of the piston from the rigid wire and the handle end of the cane for drawing the flexible wire back into the cane after the gas is released from the cane.

* * * * *